US006764324B2

(12) United States Patent
Shinozaki et al.

(10) Patent No.: US 6,764,324 B2
(45) Date of Patent: Jul. 20, 2004

(54) LEVER-TYPE CONNECTOR ASSEMBLY

(75) Inventors: Tetsuya Shinozaki, Yokkaichi (JP); Masashi Saito, Yokkaichi (JP); Keigo Atsumi, Yokkaichi (JP); Masanori Wakui, Toyota (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/375,753

(22) Filed: Feb. 26, 2003

(65) Prior Publication Data

US 2003/0162427 A1 Aug. 28, 2003

(30) Foreign Application Priority Data

Feb. 26, 2002 (JP) ..... 2002-049425

(51) Int. Cl.[7] ..... H01R 13/62
(52) U.S. Cl. ..... 439/157; 439/372
(58) Field of Search ..... 439/157, 372

(56) References Cited

U.S. PATENT DOCUMENTS

| | | | |
|---|---|---|---|
| 4,875,873 A | 10/1989 | Ishizuka et al. | |
| 5,171,156 A | 12/1992 | Nagasaka et al. | |
| 5,201,665 A | 4/1993 | McCardell et al. | |
| 5,569,040 A | 10/1996 | Sumida | |
| 5,790,373 A | 8/1998 | Kim et al. | |
| 5,876,225 A | 3/1999 | Katsuma et al. | |
| 5,924,880 A | 7/1999 | Watanabe et al. | |
| 6,193,532 B1 | 2/2001 | Smithson | |
| 6,293,813 B1 * | 9/2001 | Johnston et al. | 439/157 |
| 6,354,164 B1 | 3/2002 | Megason et al. | |
| 6,471,527 B2 | 10/2002 | Fukamachi et al. | |
| 6,544,053 B2 | 4/2003 | Hah et al. | |
| 6,547,574 B2 | 4/2003 | Sasaki et al. | |
| 6,549,424 B1 | 4/2003 | Beseth et al. | |
| 2001/0046798 A1 | 11/2001 | Noro et al. | |
| 2001/0053621 A1 | 12/2001 | Muramatsu et al. | |

FOREIGN PATENT DOCUMENTS

| | | |
|---|---|---|
| JP | 08-180930 | 7/1996 |
| JP | 10-106665 | 4/1998 |
| JP | 10-241801 | 9/1998 |

* cited by examiner

*Primary Examiner*—Ross Gushi
(74) *Attorney, Agent, or Firm*—Gerald E. Hespos; Anthony J. Casella

(57) ABSTRACT

A lever-type connector assembly has mating female and male connectors (10, 50). The female connector (10) has a lever (40) with a cam plate (41) and a resilient lock (46) that is deformable within the plane of the cam plate (41). The resilient lock (46) engages a receiving portion (33A) on the female connector (10) for holding the lever (40) at an initial position. The connector (50) has an unlocking rib (55) that deforms the resilient lock (46) out of engagement with the receiving portion (33A). As a result, the lever (40) can rotate for connecting the connectors (10, 50). Since the resilient lock (46) deforms in the plane of the cam plate (41), there is no need to provide space for deformation of the resilient lock (46) along a thickness direction of the cam plate (41).

16 Claims, 13 Drawing Sheets

LEVER-TYPE CONNECTOR ASSEMBLY

BACKGROUND OF THE INVENTION

1. Field of the Invention

The present invention relates to a lever-type connector assembly.

2. Description of the Related Art

A lever-type connector assembly has first and second connectors that can be connected together. The first connector has a housing and a lever is mounted on the housing. The lever typically is U-shaped and has two cam plates connected by an operable portion. Each cam plate is mounted rotatably on a supporting shaft provided at the left and right side surfaces of the housing. Thus, the lever is located right outside the left and right sides of the housing. Each cam plate also is formed with a cam groove. Cam pins project from the second connector and engage the cam grooves of the lever. The lever can be rotated in this state and the two connectors are pulled toward each other and connected by the cam action of the cam grooves and the cam pins.

The lever of the above-described connector assembly must be held at an initial stage where the cam grooves of the lever are in a position for receiving the cam pins. To this end, a lever-type connector assembly disclosed, for example, in U.S. Pat. No. 5,876,225 is constructed such that each cam plate has a projection engageable with a housing. The lever is held at an initial position by engaging the projections with the housing. The projections and the housing are engaged with and disengaged from each other by resiliently deforming the cam plates along the thickness direction of the cam plates.

The connector assembly described above occasionally must be made smaller in a direction of the rotational axis of the lever, which is the thickness direction of the cam plates. However, the conventional connector assembly needs to ensure a space for permitting the resilient deformation of the cam plates in the thickness direction of the cam plate to hold the lever at the initial position. This hinders the miniaturization of the connector assembly.

The present invention was developed in view of the above problem and an object thereof is to provide a lever-type connector assembly which can be made smaller in the thickness direction of a cam plate portion.

SUMMARY OF THE INVENTION

The invention relates to a lever-type connector assembly with first and second connectors that are connectable with each other. A lever is rotatably mounted in a housing of the first connector and has at least one cam plate. A cam means is provided at the second connector and is engageable with a mating cam means of the cam plate. The cam means engages the mating cam means while the lever is at an initial position. The lever then is rotated and the two connectors are pulled toward each other for connection by the cam action of the mating cam means and the cam means. The cam plate comprises at least one resilient lock that is engageable with the housing to temporarily hold or lock the lever at the initial position. The resilient lock is deformable at an angle, and preferably substantially a right angle, to the rotation axis of the lever. Accordingly, a space needed for permitting the resilient deformation of the resilient lock is reduced and no space is needed for permitting resilient deformation of the cam plate in the thickness direction, as in the prior art. As a result, the connector assembly can be made smaller.

The cam means preferably comprises a cam pin at the second connector and the mating cam means preferably comprises a cam groove formed in the cam plate for engaging the cam pin.

The resilient lock preferably is resiliently deformable substantially along a plane surface of the cam plate. Accordingly, there is no need to provide space for resilient deformation of the cam plate in the thickness direction, and the connector assembly can be made smaller.

The cam plate preferably is formed with a substantially round bearing hole. A mount groove extends from the bearing hole to an outer edge of the cam plate and is narrower than the inner diameter of the bearing hole. The housing preferably has a supporting shaft with a major outer dimension for closely fitting into the bearing hole and a minor outer dimension sufficiently small for the supporting shaft to pass through the mount groove. Accordingly, the supporting shaft can be fit into the mount groove so that the widthwise direction of the mount groove conforms to the minor dimension of the supporting shaft. The lever is rotated about the supporting shaft and locked after the supporting shaft passes through the mount groove and engages in the bearing hole. In this way, the lever can be mounted easily.

The second connector preferably has at least one unlocking rib disposed for contacting the resilient lock at an initial connection stage, thereby canceling a locked state of the lever with the housing. Accordingly, the lever can be rotated from the initial position, and the two connectors can be connected smoothly with each other.

The second connector preferably has a substantially rectangular receptacle for receiving the first connector, and the unlocking rib also is disposed for preventing an upside-down or improper insertion of the first connector into the receptacle. Accordingly, the construction is simpler than a connector with a separate means for preventing upside down insertion.

The rotation of the lever preferably is guided by rotation guiding means on the housing and/or the lever.

An accommodating recess preferably is defined between an outer wall and an intermediate wall of the housing for accommodating the lever. The cam plate is held between the outer wall and the intermediate wall while defining a small clearance therebetween.

The lever-type connector assembly may further comprise a connection completing resilient locking piece for locking the lever at a connection completing position. The connection completing resilient locking piece may be resiliently deformable in a direction different than the resilient lock, and preferably in a direction of the rotational axis of the lever.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
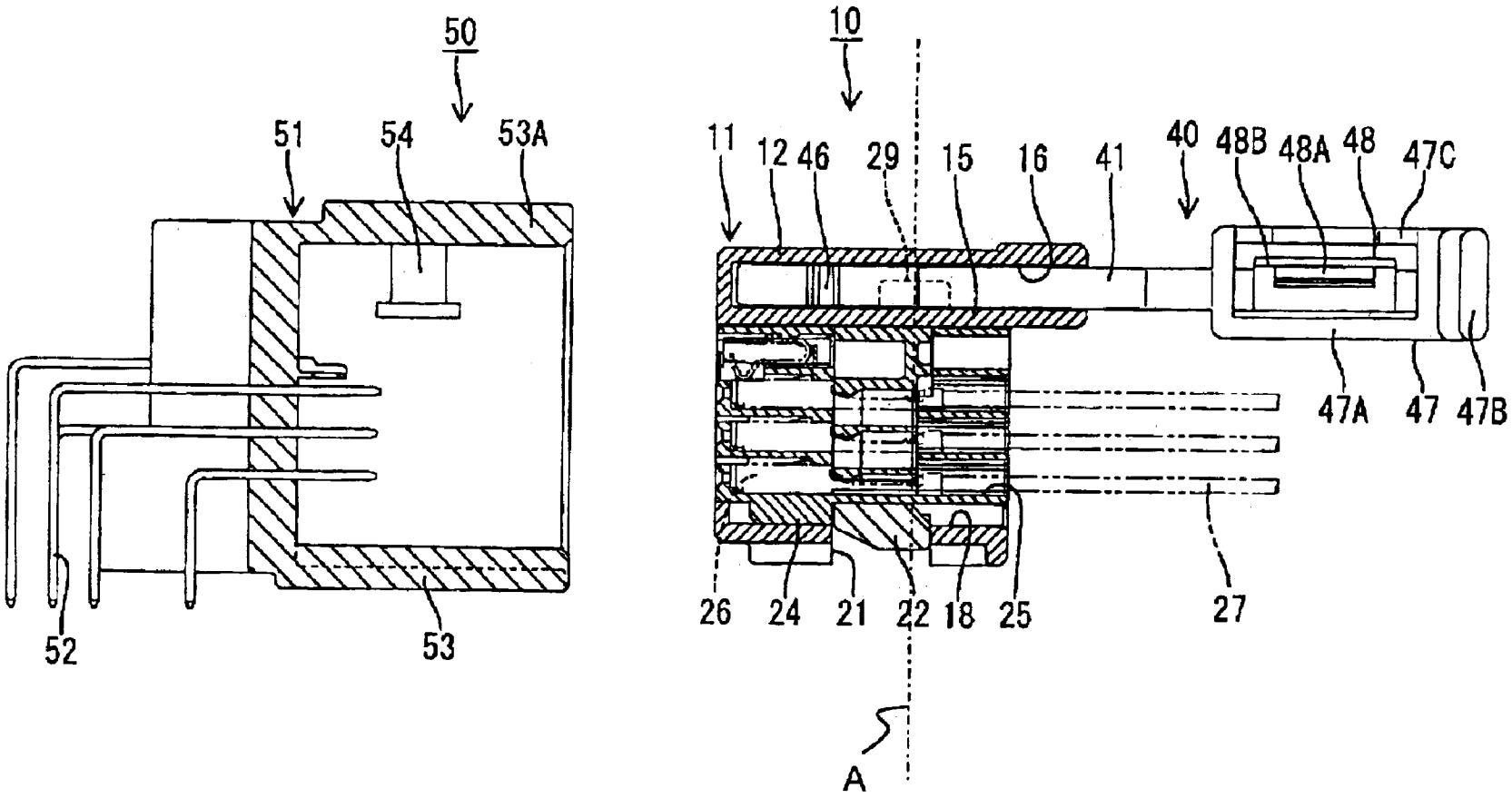
FIG. 1 is an exploded longitudinal sectional view of a female connector and a male connector of the present invention.
Figure 2:
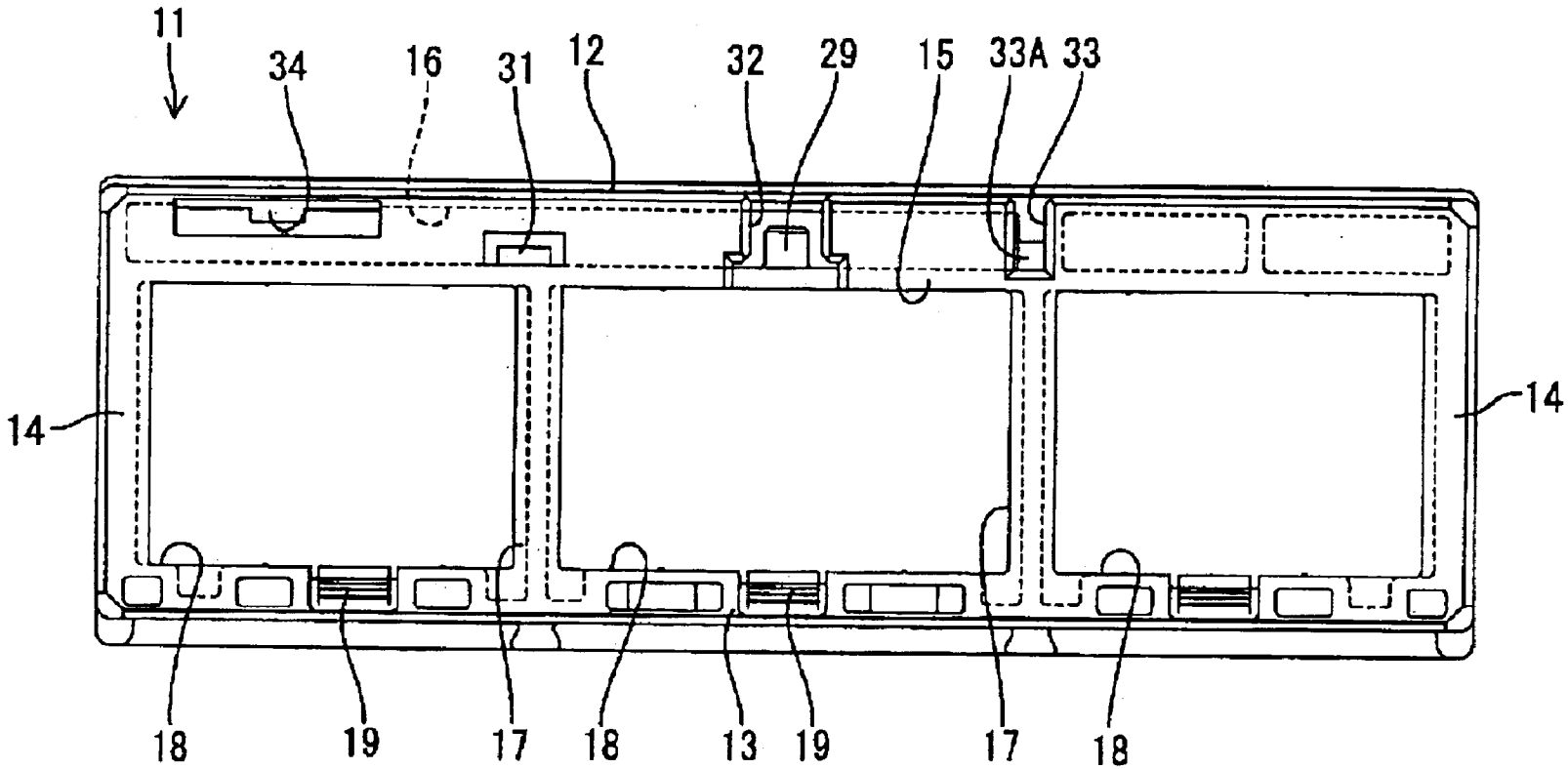
FIG. 2 is a front view of a holder.
Figure 3:
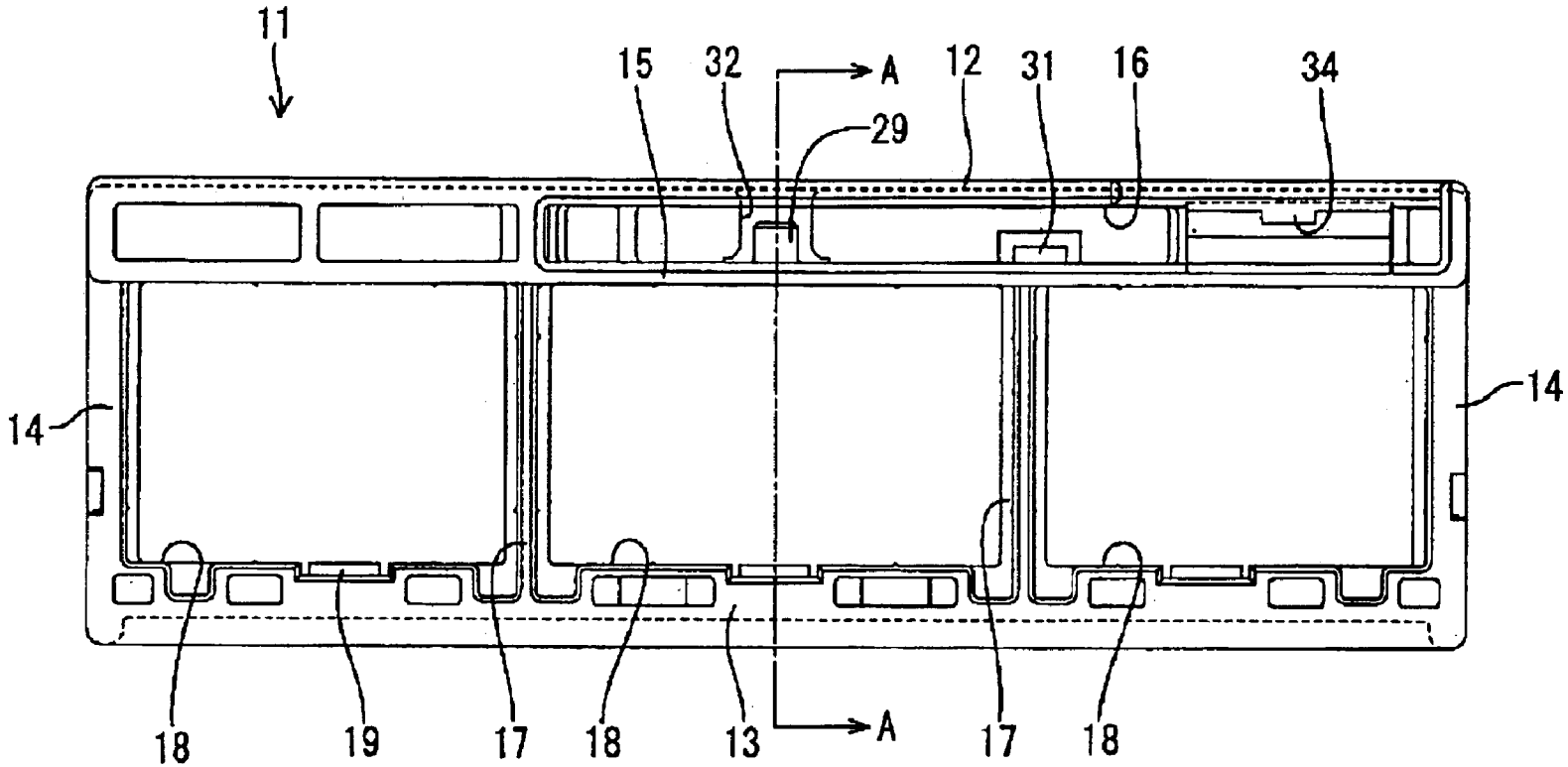
FIG. 3 is a rear view of the holder.
Figure 4:
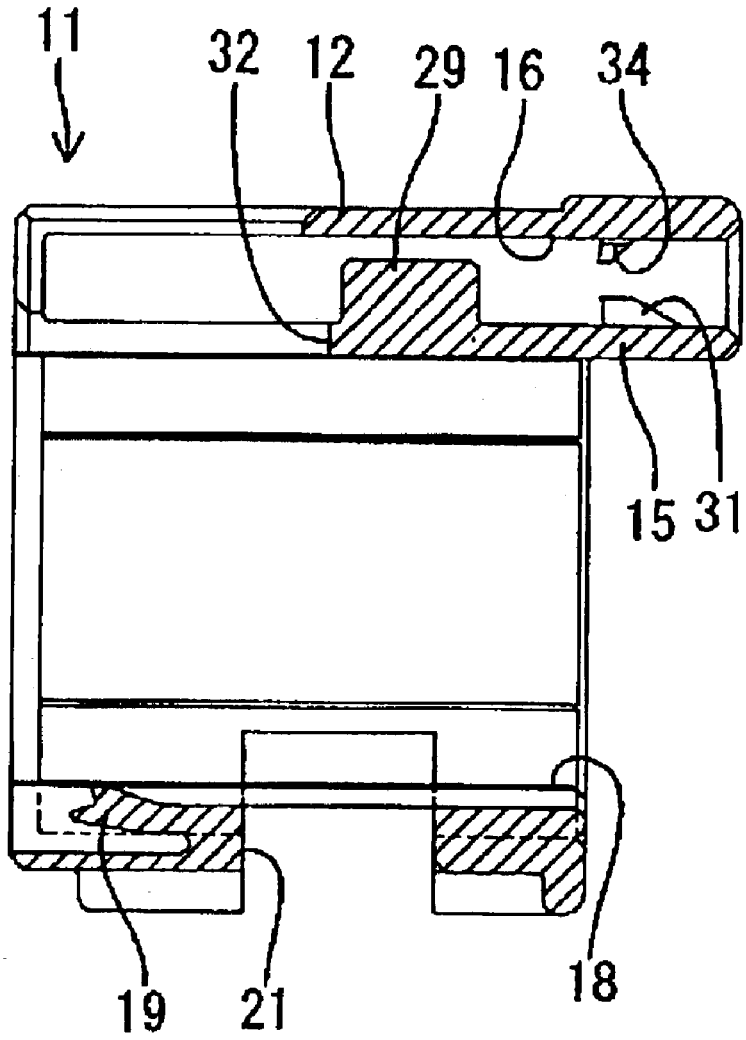
FIG. 4 is a sectional view along 4—4 of FIG. 3.

A lever-type connector assembly according to the invention includes a female connector 10 and a male connector 50, as shown in FIG. 1 which are connectable with and separable from each other. The side of each connector 10, 50 to be connected with a mating side is referred to as a front side in the following description.

The female connector 10 includes a holder 11 that is formed e.g. of a synthetic resin. The holder 11, as shown in FIGS. 2 to 5 is substantially in the shape of a wide rectangular frame that is hollow in forward and backward directions. More particularly, the holder 11 has an upper wall 12, a lower wall 13 and left and right side walls 14. A ceiling wall 15 is substantially parallel with the upper wall 12 and is between the upper and lower walls 12 and 13 to define a wide slit-like accommodating recess 16. The inner space of the holder 11 below the accommodating recess 16 is divided into three transversely arranged mount spaces 18 by two partition walls 17 provided between the ceiling wall 15 and the lower wall 13. The lower wall 13 is formed with resiliently deformable locks 19 corresponding to the respective mount spaces 18. Further, a wide recess 21 is formed in the lower wall 13 of the holder 11, and a retainer 22 is fit into the recess 21 from below.

The female connector 10 also includes auxiliary connectors 24 formed e.g. of a synthetic resin and having the shape of a substantially rectangular block (see FIG. 1). Cavities 25 are formed in the auxiliary connectors 24, and a female terminal fitting 26 are inserted respectively into the cavities 25 from behind. A wire 27 is secured to each female terminal fitting 26 and is drawn out through the rear end of the auxiliary connector 24. Each auxiliary connector 24 is inserted into the corresponding mount space 18 of the holder 11 from behind and in the inserting direction. Front and rear ends of the mounted auxiliary connectors 24 are substantially flush with the front and rear end surfaces of the holder 11. The mounted auxiliary connectors 24 are locked doubly locked by the locks 19 and the retainer 22 fitted in the recess 21.

A supporting shaft 29 projects up from the ceiling wall 15 in the accommodating recess 16 of the holder 11. Each of the front and rear surfaces of the supporting shaft 29 has an arcuate cross section, and a diametrical dimension D is defined on the supporting shaft 29 between the front and rear surfaces thereof. Substantially parallel flat surfaces 29A are formed at the left and right sides of the supporting shaft 29. A transverse dimension W between the flat portions 29A of the supporting shaft 29 is smaller than the dimension D between the front and rear surfaces.

A stopper 31 projects on the upper surface of the ceiling wall 15 in the accommodating recess 16 of the holder 11. Additionally, an escaping groove 32 is formed in the upper wall 12 and the ceiling wall 15 of the holder 11 in front of the supporting shaft 29. Another escaping groove 33 is formed at a side position of the accommodating recess 16 of the holder 11. The escaping groove 33 extends backward from the front surface of the holder 11, and a receiving portion 33A projects at the rear lower half of the escaping groove 33.

Figure 5:
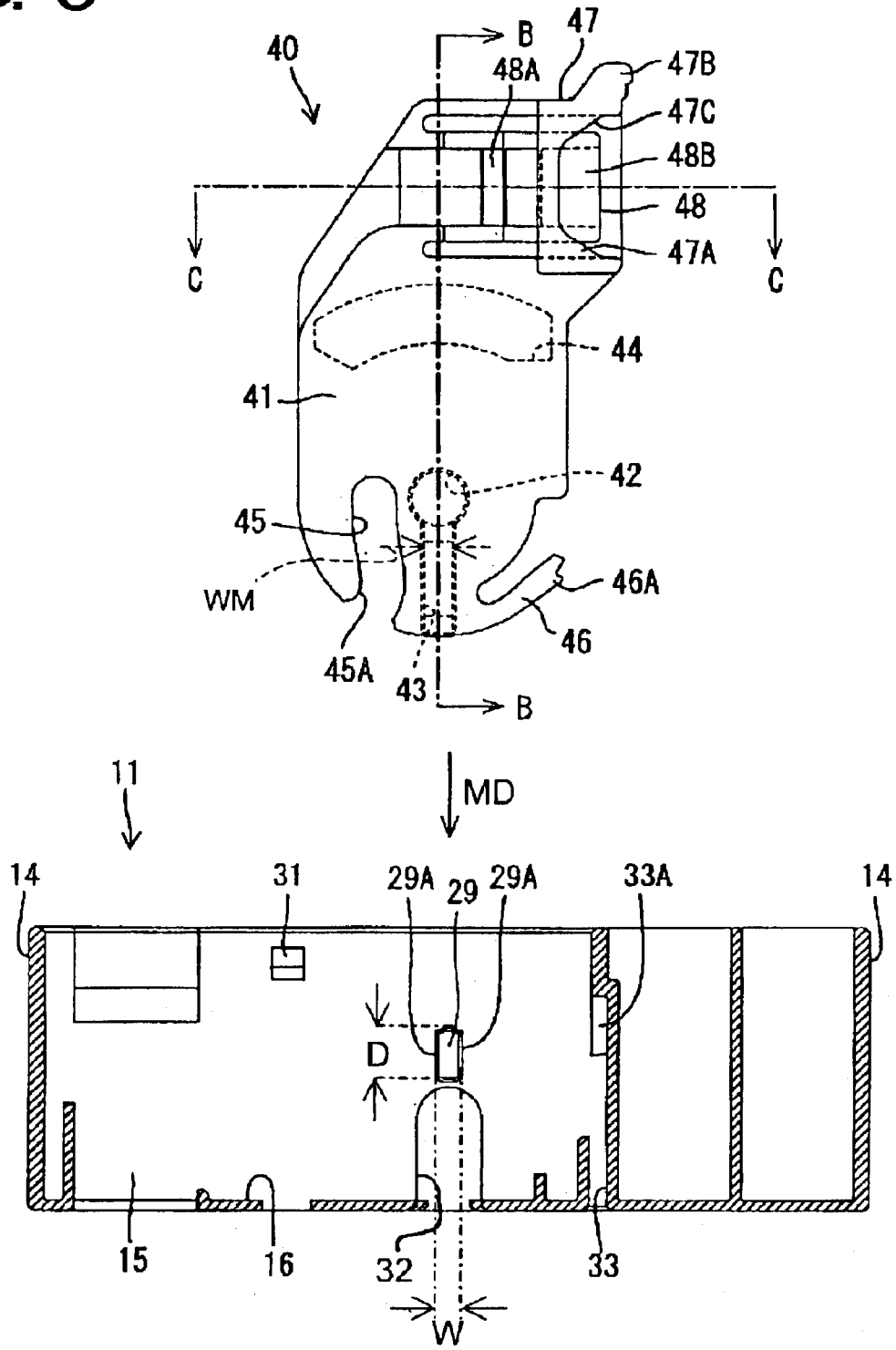
FIG. 5 is a horizontal sectional view showing a state before a lever is mounted into the holder.
Figure 6:
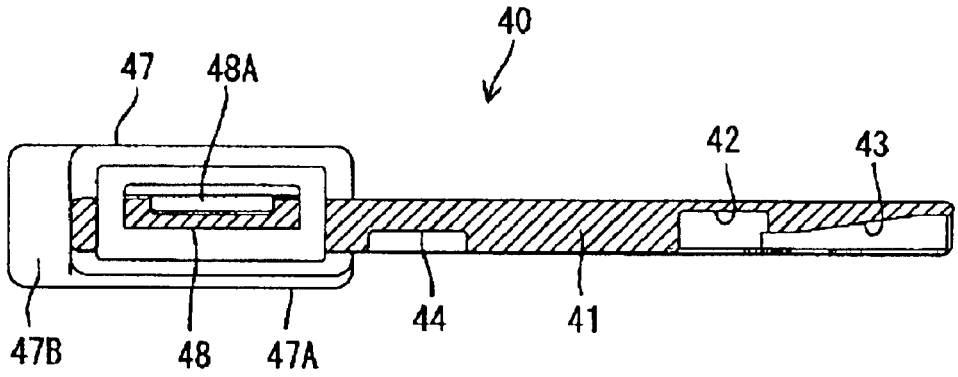
FIG. 6 is a sectional view along 6—6 of FIG. 5.
Figure 7:
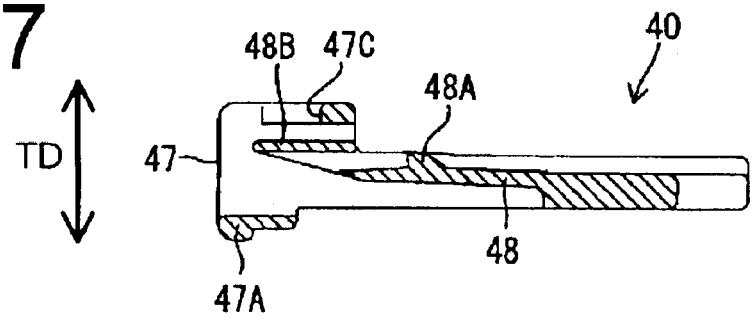
FIG. 7 is a sectional view along 7—7 of FIG. 5.

The female connector 10 further includes a lever 40, as shown in FIGS. 5 to 7. The lever 40 is formed e.g. of a synthetic resin and includes a long narrow substantially flat cam plate 41. A substantially round bearing hole 42 is formed at a lower surface of the cam plate 41 near one end of the cam plate 41. The bearing hole 42 of the lever 40 is mounted rotatably about the supporting shaft 29 of the ceiling wall 15. Thus, the lever 40 is accommodated in the accommodating recess 16 so that the cam plate 41 is held with a small clearance between the upper wall 12 and the ceiling wall 15.

A mount groove 43 is formed in the lower surface of the cam plate 41 and extends from the bearing hole 42 to the outer edge of the cam plate 41 substantially along the longitudinal direction of the cam plate portion 41 and along a mounting direction MD of the lever 40 to the holder 11. The mount groove 43 is adapted to guide the supporting shaft 29 to the bearing hole 42 when the lever 40 is mounted into the holder 11. The width WM of the mount groove 43 is slightly larger than the transverse dimension W between the flat portions 29A of the supporting shaft 29. Further, the depth of the mount groove 43 is smaller than the projecting distance of the supporting shaft 29 and is made gradually smaller toward the bearing hole 42 (see FIG. 6) to form a step between the bottom surface of the bearing hole 42 and the bottom surface of the mount groove 43.

Figure 10:
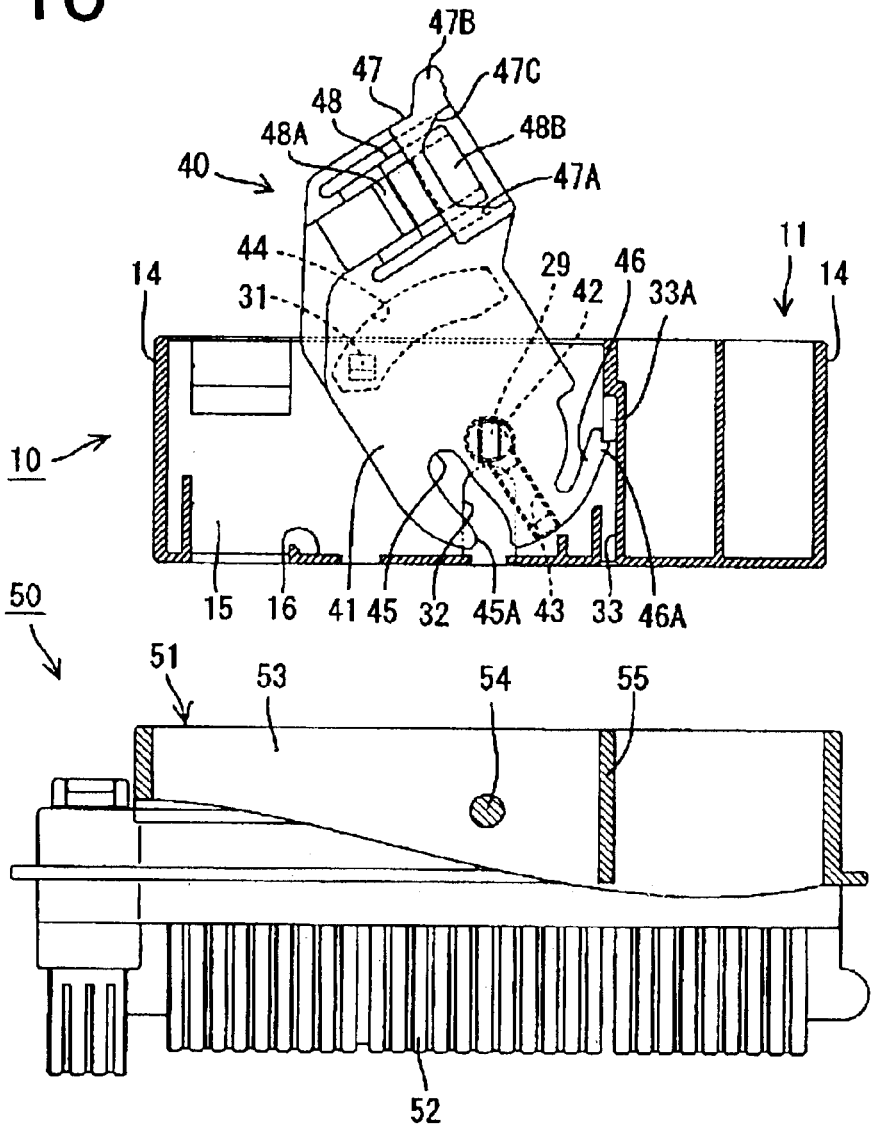
FIG. 10 is a horizontal sectional view showing a state before the female and male connectors are connected.
Figure 13:
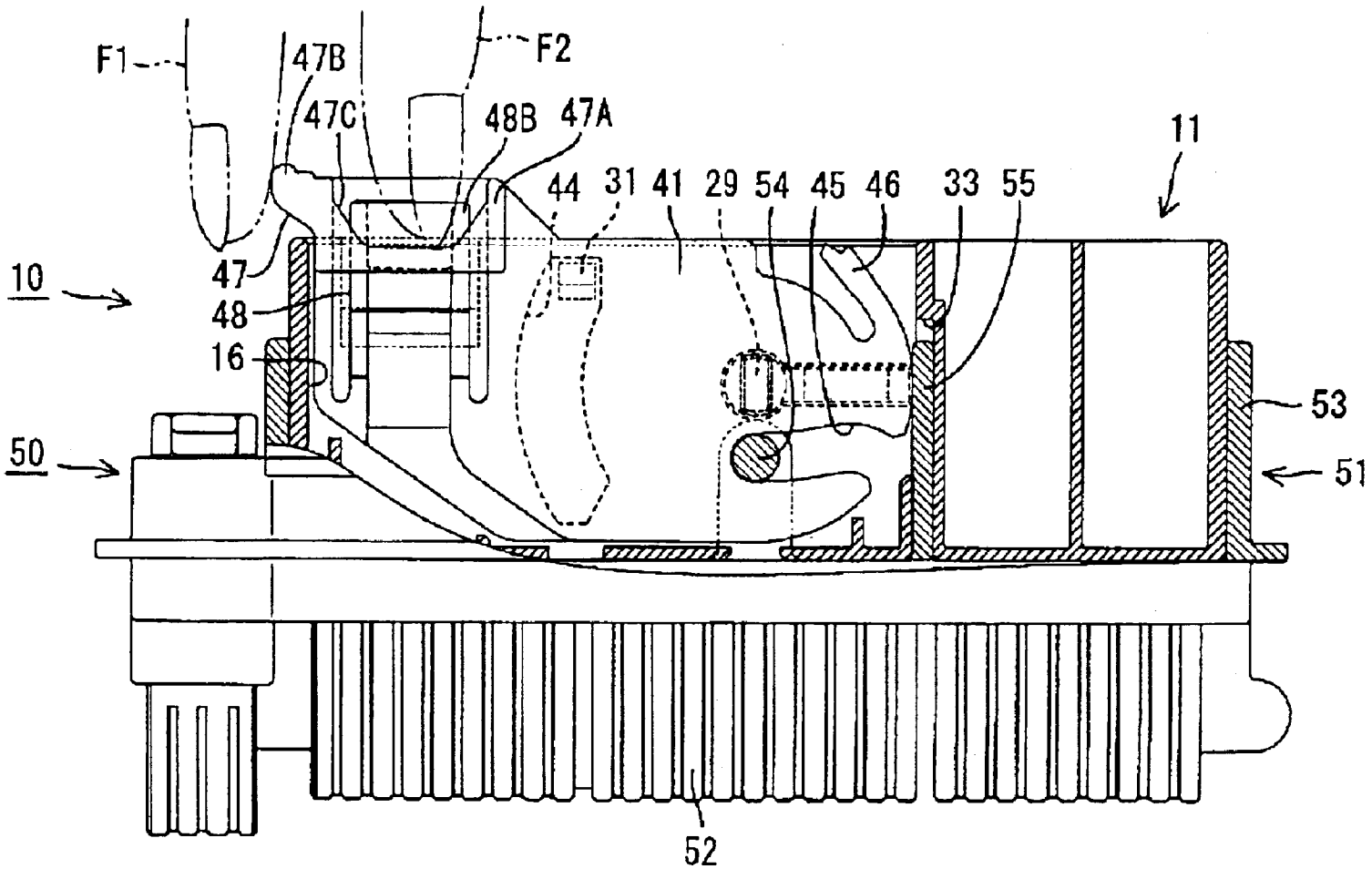
FIG. 13 is a horizontal sectional view showing a state where the connection of the female and male connectors is completed.

A rotation guiding groove 44 is formed in the lower surface of the cam plate 41 and is substantially in the form of a fan with a center at the bearing hole 42. The stopper 31 on the upper surface of the ceiling wall 15 in the accommodating recess 16 of the holder 11 is engageable with the rotation guiding groove 44. A rotatable range of the lever 40 is defined by the opposite ends of the rotation guiding groove 44 along which the stopper 31 is displaceable. Thus, the lever 40 is rotatable between an initial position, as shown in FIG. 10, and a connection completing position, as shown in FIG. 13.

A cam groove 45 is formed in the cam plate 41 near the bearing hole 42 and is engageable with a cam pin 54 of the male connector 50. An opening 45A of the cam groove 45 is located at the outer edge of the cam plate 41. The opening 45A of the cam groove 45 substantially aligns with the escaping groove 32, when the lever 40 is at the initial position. Thus, the cam groove 45 is ready for receiving the cam pin 54.

A resilient locking piece 46 is cantilevered from an end of the cam plate 41 at a side substantially opposite the cam groove 45 with respect to the mount groove 43. The resilient locking piece 46 extends substantially along the plane of the cam plate 41. The width (vertical dimension) of the resilient locking piece 46 is the same as the thickness of the cam plate 41, and the leading end of the resilient locking piece 46 is resiliently deformable substantially along the plane of the cam plate 41. A projection 46A projects outward at the leading end of the resilient locking piece 46. The projection 46A of the resilient locking piece 46 enters the escaping groove 33 when the lever 40 is at the initial position, and the lower half of the projection 46A engages the receiving portion 33A for locking. Thus rotation of the lever 40 toward the connection completing position is prevented.

The lever 40 also has an operable portion 47 at an end of the cam plate 41 substantially opposite from the bearing hole 42. The operable portion 47 is near the rear surface side of the holder 11 at the connection completing position. The operable portion 47 has a substantially rectangular frame 47A that bulges out from the cam plate 41 in the thickness direction of the cam plate 41 and a finger placing portion 47B that bulges out from the rectangular frame 47A in a direction away from the bearing hole 42. Further, a planar resilient lock 48 is cantilevered substantially in the plane of the cam plate 41 from the end of the lever 40 that has the operable portion 47 and is configured for locking the lever 40 at the connection completing position. The resilient lock 48 extends back when the lever 40 is at the connection completing position, and is resiliently deformable substantially in its thickness direction TD, which is the direction of the rotational axis of the lever 40. A locking projection 48A is provided on the upper surface of the resilient lock 48. The locking projection 48A is engageable with a claw 34 on the upper wall 12 of the holder 11 when the lever 40 is substantially at the connection completing position. Further, a finger pressing portion 48B in the form of a substantially flat plate is provided at the leading end of the resilient lock 48 for disengaging the locking projection 48A from the claw 34. The finger pressing portion 48B is inside the substantially rectangular frame 47A, and a notch 47C is formed in the upper surface of the substantially rectangular frame 47A to expose the finger pressing portion 48B.

Figure 8:
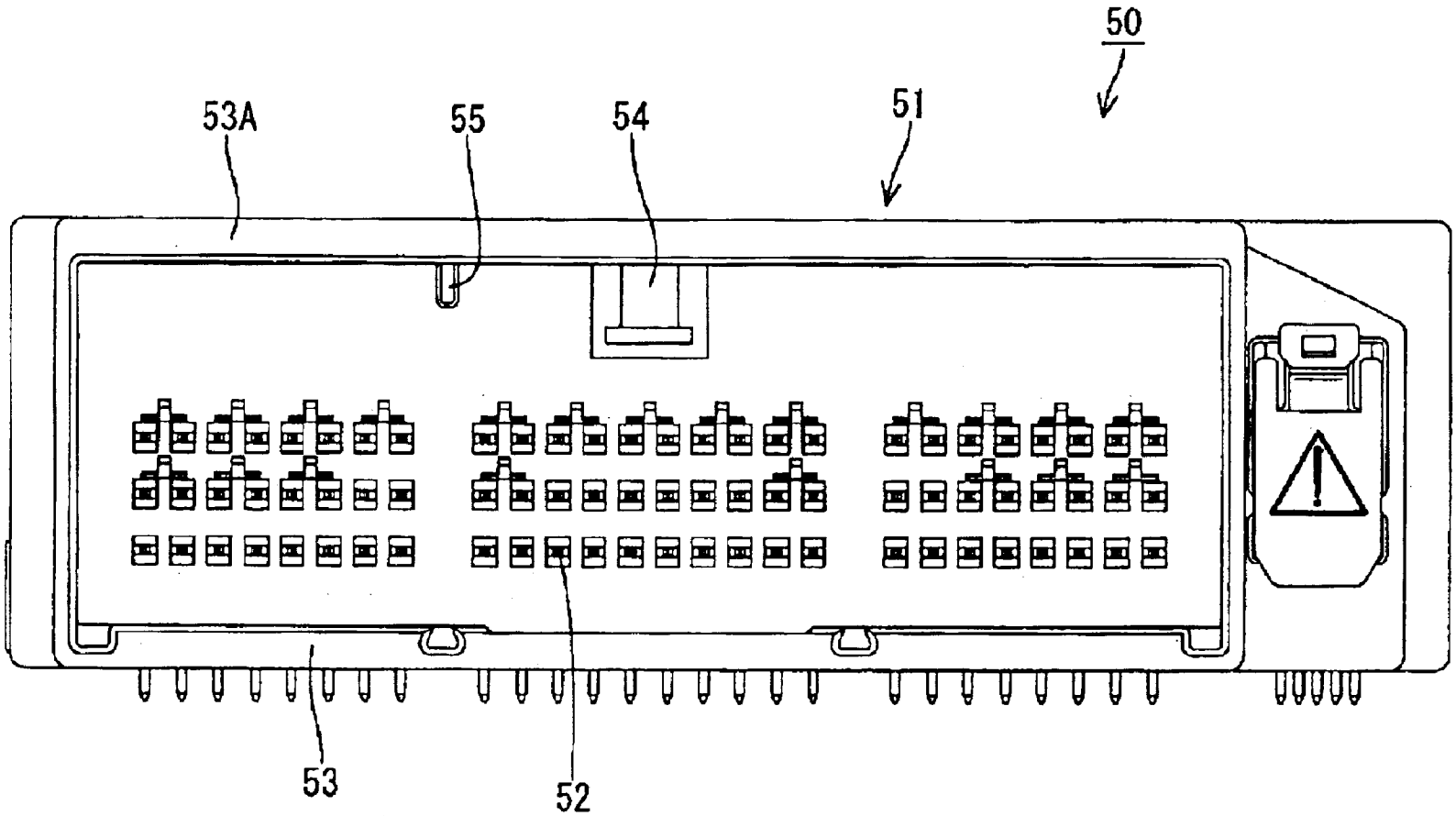
FIG. 8 is a front view of a male connector.

The male connector 50 has a housing 51 formed e.g. of a synthetic resin and male terminal fittings 52 are mounted in the housing 51, as shown in FIGS. 1, 8 and 10. A substantially rectangular receptacle 53 opens at the front side of the housing 51, and the holder 11 of the female connector 10 is insertable into the receptacle 53. The male terminal fittings 52 project into the receptacle 53 from the rear end thereof. Thus, the male and female terminal fittings 52 and 26 connect with each other when the connectors 10, 50 are connected properly.

A cylindrical cam pin 54 and an unlocking rib 55 project down from an upper plate 53A of the receptacle 53 towards the inner space of the receptacle 53. The unlocking rib 55 extends from the front end of the receptacle 53 along forward and backward directions and enters the upper half of the escaping groove 33 when the male connector 50 is connected with the female connector 10.

The connector assembly is assembled by first placing the cam plate 41 of the lever 40 substantially parallel to the upper wall 12 of the holder 11, as shown in FIG. 5. The cam plate 41 then is inserted into the accommodating recess 16 of the holder 11 so that the width direction of the mount groove 43 conforms to the width W of the supporting shaft 29, thereby guiding the supporting shaft 29 into the mount groove 43. The upper wall 12 and the ceiling wall 15 near the supporting shaft 29 deform slightly away from each other when the supporting shaft 29 is pushed into the mount groove 43 to permit passage of the supporting shaft 29. The depth of the mount groove 43 becomes gradually smaller toward the bearing hole 42 (see FIG. 6). Thus, the supporting shaft 29 easily can be pushed deeper into the mount groove 43. The upper wall 12 and the ceiling wall 15 are restored resiliently to their original shapes, as the supporting shaft 29 reaches the bearing hole 42, thereby engaging the supporting shaft 29 with the bearing hole 42 (see FIG. 9).

Figure 9:
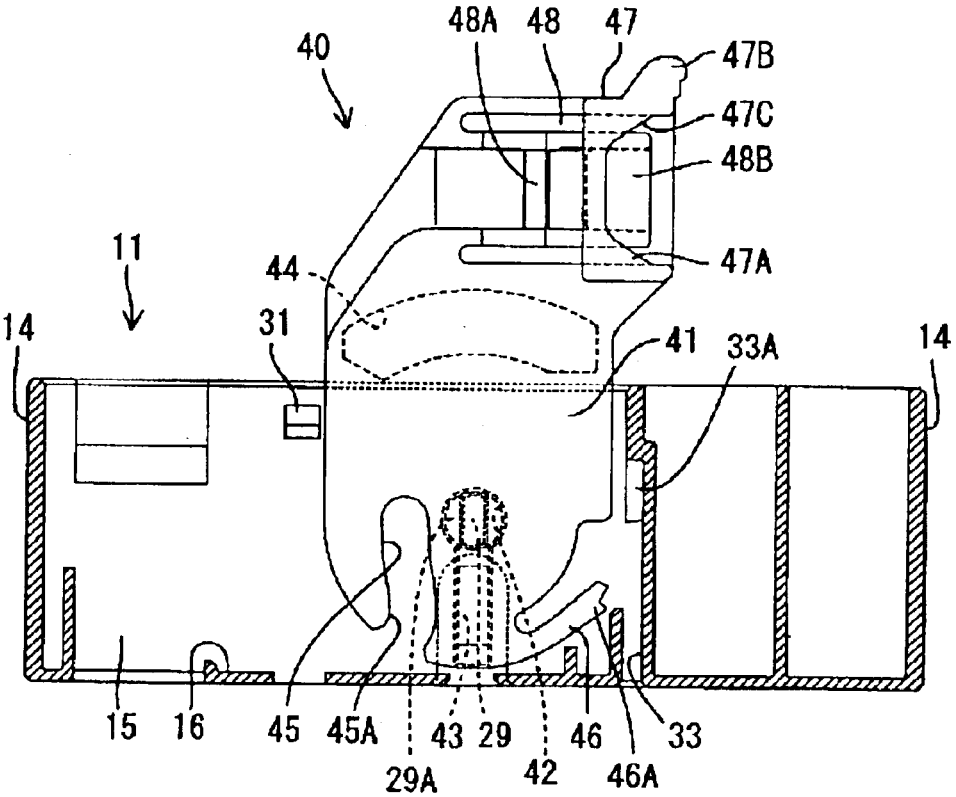
FIG. 9 is a horizontal sectional view showing a state where the lever is inserted in the holder.

Assembly proceeds by rotating the lever 40 counterclockwise from the state shown in FIG. 9. Thus, the stopper 31 is pushed under the cam plate 41, and the upper wall 12 and the ceiling wall 15 near the stopper 31 deform slightly away from each other. The lever 40 then is rotated to the initial position shown in FIG. 10 so that the stopper 31 is fit into the rotation guiding groove 44. As a result, the upper wall 12 and the ceiling wall 15 are restored resiliently to their original shapes. Accordingly, the projection 46A of the resilient lock 46 enters the escaping groove 33 and engages the receiving portion 33A to prevent rotation of the lever 40 toward the connection completing position. The orientation of the supporting shaft 29 in the bearing hole 42 deviates from the orientation of the mount groove 43 when the lever 40 is rotated in the state shown in FIG. 9. Thus, the lever 40 is locked so as not to come out. In this way, the mounting operation of the lever 40 into the holder 11 is completed.

Each auxiliary connector 24 then is fit into the corresponding mount space 18 of the holder 11, as shown in FIG. 1, and the retainer 22 is brought into engagement with the auxiliary connectors 24 to lock the auxiliary connectors 24 so as not to come out.

Figure 11:
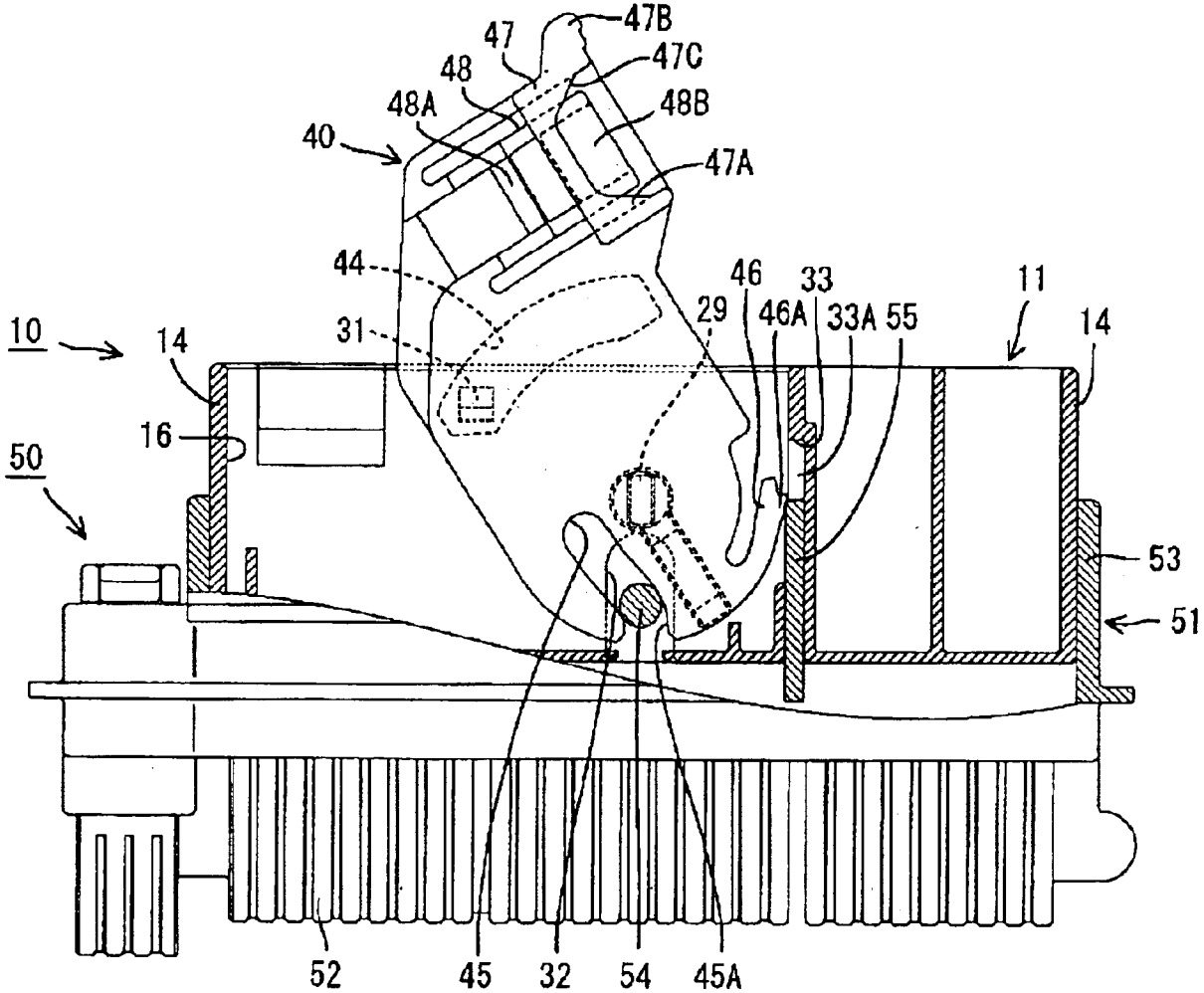
FIG. 11 is a horizontal sectional view showing an initial stage of connection of the female and male connectors.

The holder 11 of the female connector 10 then is inserted lightly into the receptacle 53 of the male connector 50. Thus, the cam pin 54 fits into the opening 45A of the cam groove 45, as shown in FIG. 11, and the unlocking rib 55 contacts the projection 46A of the resilient lock 46. As a result, the resilient lock 46 deforms and disengages from the receiving portion 33A so that the lever 40 can rotate. An attempt could be made to insert the female connector 10 into the receptacle 53 upside down. However, such insertion will bring the leading end of the unlocking rib 55 into contact with the holder 11, thereby preventing further insertion.

The lever 40 then is rotated toward the connection completing position by pushing the operable portion 47. As a result, the cam action between the cam groove 45 and the cam pin 54 pulls the connectors 10, 50 toward each other so that the holder 11 is fit further into the receptacle 53. A force resulting from connecting resistance acts upon the lever 40 during the connecting operation. However, the cam plate 41 is held substantially from the opposite sides along the thickness direction TD in the accommodating recess 16. Consequently, the cam plate 41 will not deform substantially in the direction of the rotational axis and will not disengage from the supporting shaft 29.

Figure 12:
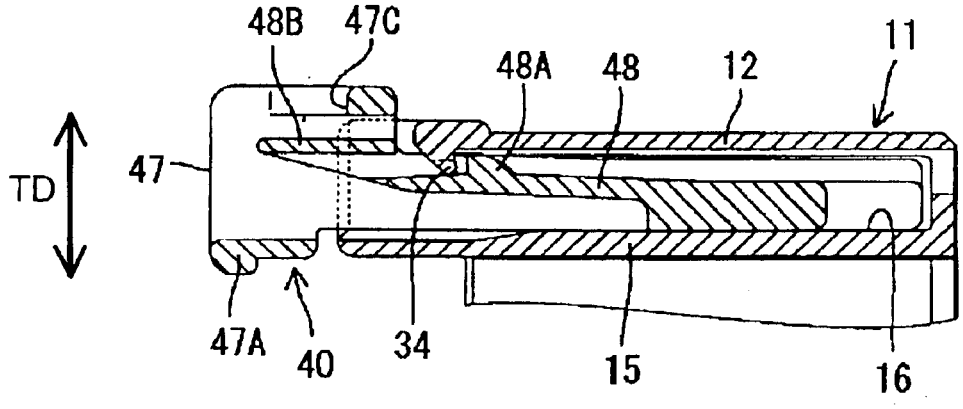
FIG. 12 is a partial enlarged longitudinal sectional view showing a state where the lever is locked at a connection completing position.
Figure 14:
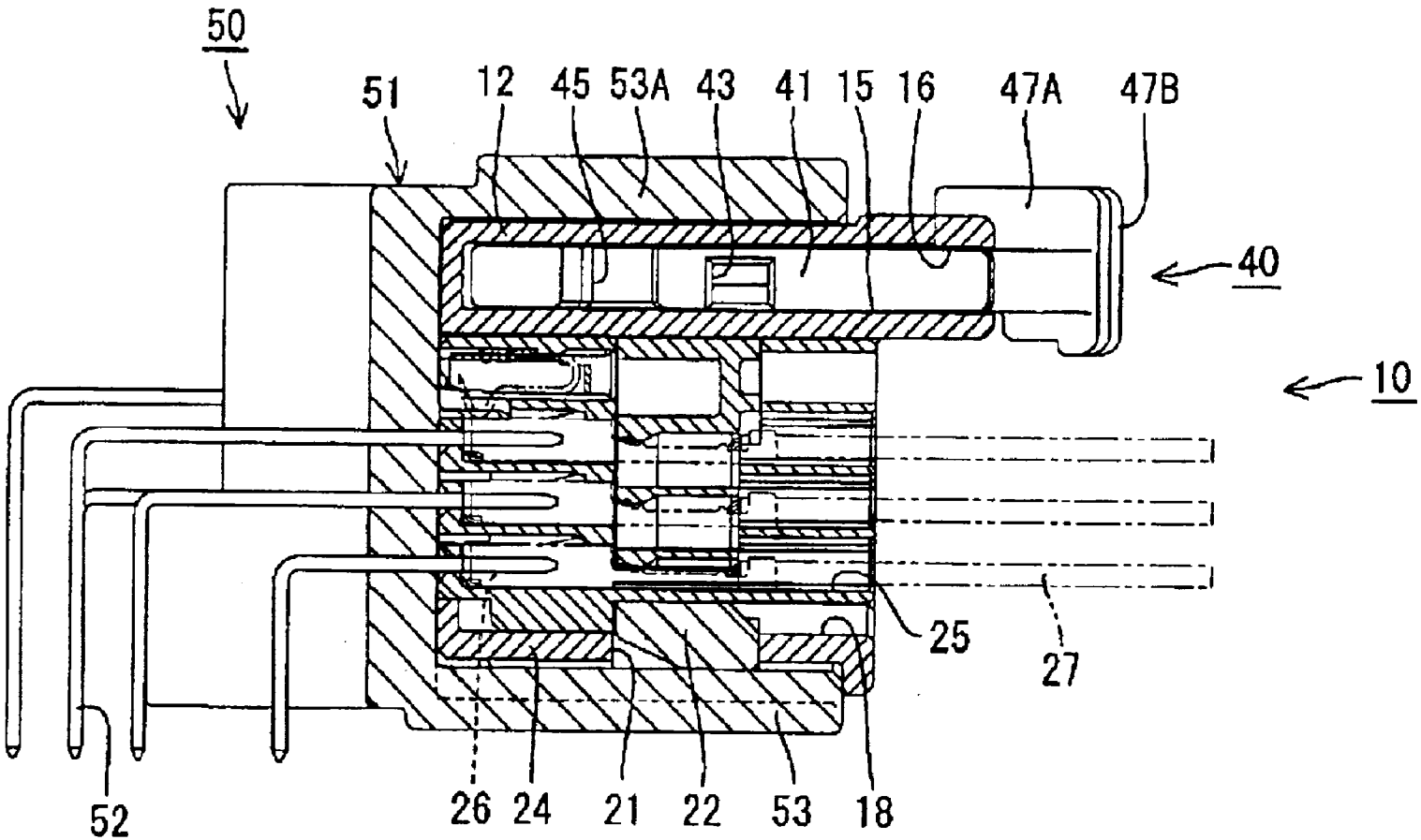
FIG. 14 is a longitudinal sectional view showing a state where the connection of the female and male connectors is completed.

The locking projection 48A of the resilient locking piece 48 contacts the claw 34 of the holder 11 when the lever 40 comes closer to the connection completing position. Thus, the resilient locking piece 48 is deformed resiliently in a direction substantially normal to the plane of the cam plate 41. The resilient locking piece 48 is restored resiliently towards its original shape when the lever 40 reaches the connection completing position and the locking projection 48A and the claw 34 engage to lock the lever 40 as shown in FIG. 12. As a result, the two connectors 10, 50 are connected properly (see FIGS. 13 and 14).

The two connectors 10, 50 can be separated by placing a forefinger F1 on the finger placing portion 47B of the operable portion 47 and pushing down on the finger pressing portion 48B of the resilient lock 48 with the tip of the thumb F2 of the same hand, as shown in FIG. 13. Thus, the lever 40 is unlocked and the operable portion 47 is pulled to rotate the lever 40 clockwise in FIG. 13. As a result, the cam pin 54 is displaced along the cam groove 45 toward the opening portion 45A, and the two connectors 10, 50 move apart. The cam pin 54 comes out of the cam groove 45 when the lever 40 reaches the initial position, and the two connectors 10, 50 are separated from each other.

As described above, the resilient lock 46 for locking the lever 40 at the initial position is deformed along the planar surface of the cam plate 41. Thus, there is no need to provide space for permitting the deformation of the cam plate 41 along the thickness direction, and the connector assembly can be made smaller.

The supporting shaft 29 is fit into the mount groove 43 so that the width direction of the mount groove 43 substantially conforms to the shorter dimension W of the supporting shaft 29. The supporting shaft 29 passes easily through the mount groove 43 and engages the bearing hole 42. The lever 40 is locked merely by rotation about the supporting shaft 29. In this way, the lever 40 can be mounted easily.

The unlocking rib 55 contacts the resilient lock 46 at an initial connection stage to unlock the lever 40. As a result, the lever 40 can be rotated from the initial position. Therefore, the two connectors 10, 50 can be connected smoothly.

The unlocking rib 55 also serves as the rib for preventing the upside-down insertion of the female connector 10 into the receptacle 53. Therefore, the construction can be simplified.

The invention is not limited to the above described and illustrated embodiment. For example, the following embodiments are also embraced by the technical scope of the present invention as defined in the claims. Beside the following embodiments, various changes can be made without departing from the scope and spirit of the present invention as defined in the claims.

In the foregoing embodiment, the lever is mounted in the holder of the split-type connector. However, the lever may also be mounted in housings of connectors other than the split-type connector.

The lever extends along a wall at one side of the holder in the foregoing embodiment. However, the lever also may be U-shaped and located outside the left and right sides of the housing according to the invention.

In the foregoing embodiment, the lever is locked at the initial stage by the resilient lock and is unlocked by the unlocking rib of the male connector. However, the resilient lock may take a semi-locking construction without providing an unlocking means in the mating connector, so that the locked state is canceled by pushing the lever from the initial position to the connection completing position.

What is claimed is:

1. A lever-type connector assembly, comprising:

first and second connectors connectable with each other, the first connector having a housing;

a lever rotatably mounted in the housing of the first connector for rotation about a rotational axis and provided with at least one cam plate with a cam portion;

a cam means provided at the second connector for engaging with the cam portion of the cam plate, wherein:

the cam means engages the cam portion while the lever is at an initial position, and generates a cam action in response to rotation of the lever for pulling the first and second connectors toward each other for connection;

the cam plate comprises at least one resilient lock engageable with the housing to hold the lever at the initial position, the resilient lock being resiliently deformable at an angle to the rotational axis of the lever; and the second connector having at least one unlocking rib for contacting the resilient lock at an initial connection stage, thereby canceling a lock state of the lever with the housing.

2. The lever-type connector assembly of claim 1, wherein the cam means comprises a cam pin provided at the second connector and the cam portion comprises a cam groove formed in the cam plate and configured for engaging the cam pin.

3. The lever-type connector assembly of claim 1, wherein the resilient lock is resiliently deformable parallel to a surface of the cam plate.

4. The lever-type connector assembly of claim 1, wherein the second connector has a substantially rectangular receptacle for receiving the first connector, and the unlocking rib being disposed for preventing an upside-down insertion of the first connector into the receptacle.

5. The lever-type connector assembly of claim 1, further comprising rotation guiding means on at least one of the housing and the lever for guiding rotation of the lever.

6. The lever-type connector assembly of claim 1, wherein an accommodating recess is defined between an outer wall and an intermediate wall of the housing for accommodating the lever, and wherein the cam plate is held between the outer wall and the intermediate wall with a small clearance.

7. The lever-type connector assembly according of claim 1, further comprising a connection completing resilient locking piece for locking the lever at a connection completing position.

8. The lever-type connector assembly of claim 7, wherein the connection completing resilient locking piece is resiliently deformable in a direction of the rotational axis of the lever.

9. A lever-type connector assembly, comprising;

first and second connectors connectable with each other, the first connector having a housing;

a lever rotatably mounted in the housing of the first connector for rotation about a rotational axis and provided with at least one cam plate with a cam portion;

a cam means provided at the second connector for engaging with the cam portion of the cam plate, wherein:

the cam means engages the cam portion while the lever is at an initial position, and generates a cam action in response to rotation of the lever for pulling the first and second connectors toward each other for connection;

the cam plate comprises at least one resilient lock engageable with the housing to hold the lever at the initial position, the resilient lock being resiliently deformable at an angle to the rotational axis of the lever; and the cam plate being formed with a substantially round bearing hole and a mount groove extending from the bearing hole to an outer edge of the cam plate and having a width smaller than an inner diameter of the bearing hole.

10. The lever-type connector assembly of claim 9, wherein the housing has a supporting shaft with a major outer dimension for closely fitting into the bearing hole and a minor outer dimension so that the supporting shaft can pass through the mount groove.

11. The lever-type connector assembly according of claim 9, wherein the second connector has at least one unlocking rib for contacting the resilient lock at an initial connection stage, thereby canceling a locked state of the lever with the housing.

12. A lever-type connector assembly, comprising:

a first connector having a housing and a lever mounted to the housing for rotation about a rotational axis, a first cam and a resilient lock formed on the lever, the resilient lock being configured for locked engagement with the housing to hold the lever at an initial position, the resilient lock being resiliently deformable about an axis substantially parallel to the rotational axis of the lever; and a second connector with a receptacle for receiving the housing of the first connector, a second cam engageable with the first cam for generating a cam action in response to rotating the lever for connecting the first and second connectors, the second connector having an unlocking rib for engaging the resilient lock and deflecting the resilient lock out of the locked engagement with the housing.

13. The lever-type connector assembly of claim 12, wherein the second cam comprises a cam pin on the second connector, and the first cam means comprises a cam groove formed in the lever and configured for engaging the cam pin.

14. The lever-type connector assembly of claim 13, wherein the lever comprises a substantially planar cam plate aligned substantially normal to the rotational axis, the resilient lock being deformable substantially in a plane defined by the cam plate.

15. The lever-type connector assembly of claim 14, wherein the unlocking rib is disposed for preventing inverted insertion of the first connector into the receptacle.

16. A connector assembly comprising:

a first connector;

a second connector having a receptacle for receiving the first connector, the receptacle being formed with a cam and an unlocking rib; and a lever have a substantially planar cam plate mounted on the first connector for rotation between an initial position and a connection completing position, the cam plate having a mating cam disposed and configured for engaging the cam of the receptacle when the lever is in the initial position and for pulling the connectors toward each other as the lever is rotated to the connection completing position, the lever comprising a resilient lock configured for locked engagement with the first connector for holding the lever at the initial position, the resilient lock being resiliently deformable substantially in a plane defined by the planar cam plate, the resilient lock being disposed for engagement by the unlocking rib of the receptacle so that the unlocking rib deflects the resilient lock out of the locked engagement with the first connector.

* * * * *